United States Patent [19]

Kiyokane

[11] Patent Number: 4,986,685

[45] Date of Patent: Jan. 22, 1991

[54] WRITING INSTRUMENT

[75] Inventor: Jerrilyn C. Kiyokane, Torrance, Calif.

[73] Assignee: Namkung Promotions, Inc., Costa Mesa, Calif.

[21] Appl. No.: 442,777

[22] Filed: Nov. 28, 1989

[51] Int. Cl.[5] ..... A43K 7/00

[52] U.S. Cl. ..... 401/213; 401/88; D19/42; D19/57; 446/146

[58] Field of Search ..... 401/88, 98, 202, 209, 401/213, 195; D1/106, 104, 128; D9/329, 307, 426; D3/65; D19/42, 41, 57; 446/146X

[56] References Cited

U.S. PATENT DOCUMENTS

| | | | |
|---|---|---|---|
| D. 292,297 | 10/1987 | Bingham | D19/42 |
| D. 302,985 | 8/1989 | Vinck | D19/42 |
| 4,306,818 | 12/1981 | Manusch | 401/202 |
| 4,652,163 | 3/1987 | Karliner | 401/202 |
| 4,728,212 | 3/1988 | Spector | D19/42 |

*Primary Examiner*—Richard J. Johnson

*Attorney, Agent, or Firm*—James E. Brunton

[57] ABSTRACT

A novelty writing instrument which simulates the appearance of a food product such as a cookie or hamburger. Housed within the instrument is constructed from two mating parts. When the two parts are separated, the writing tip of the writing element is exposed for use.

9 Claims, 2 Drawing Sheets

WRITING INSTRUMENT

BACKGROUND OF THE INVENTION

1. Field of the Invention

The present invention relates generally to writing instruments. More particularly, the invention concerns a novelty writing device which simulates the appearance of a food article, such as a cookie, and which can be used as a promotional item by fast food establishments.

2. Discussion of the Prior Art

Ready to eat cookie outlets and fast food takeout restaurants have become very popular in recent years. Many such outlets cater to people with small children and frequently provide toys and other entertainment items along with the food served to promote the food outlet and to entertain the child. To be commercially successful, such promotional items must be clever, attractive and inexpensive to produce.

The novelty item of the present invention, which comprises a writing instrument simulating in appearance cookie or other food article, satisfies the aforementioned requirements, being both appealing to children and inexpensive to manufacture. The device can be inexpensively constructed from moldable plastic, or like material.

In one form of the invention, the writing device includes a pair of mateable semicircular portions, which, when joined together, have the appearance of a cookie. The two halves of the device enclose a writing element such as a pen or pencil. When the two halves are separated, the point of the writing element is exposed for use. The user can then grip the half of the device within which the writing element is fixedly mounted and conveniently use the device to mark upon a writing surface.

While various types of containers for pencils and pens have been suggested in the past, none have the unique appearance, construction and novelty attraction of the device of the present invention.

SUMMARY OF THE INVENTION

It is an object of the present invention to provide a novelty device in the form of a ornamental writing device simulating the appearance of a food item which can be used in fast food takeout establishments to promote their products.

Another object of the invention is to provide an item of the aforementioned character which can be inexpensively produced and delivered to the user at the time of purchase of the food product.

A further object of the invention is to provide a novelty item of the class described which is attractive to children and includes a writing instrument safely encapsulated within a circular housing when not in use.

Still another object of the invention is to provide a novelty item for use by fast food establishments and the like which performs both a practical purpose and at the same time provides an entertaining novelty and conversation piece which tends to encourage customers to return to the food establishment.

In summary, the foregoing objects are realized by an advertising device comprising a novelty writing instrument which is generally circular shaped to simulate the appearance of a food product, such as a cookie, a hamburger, or the like product, including a first, generally semicircular shaped housing portion having a radially extending cavity formed therein; a second, generally semicircular shaped housing portion which is mateable with the first housing portion, the second housing portion having a radially extending cavity formed therein; and a writing element carried within the first and second housing portions for writing on a writing surface.

DESCRIPTION OF THE INVENTION

Figure 1:
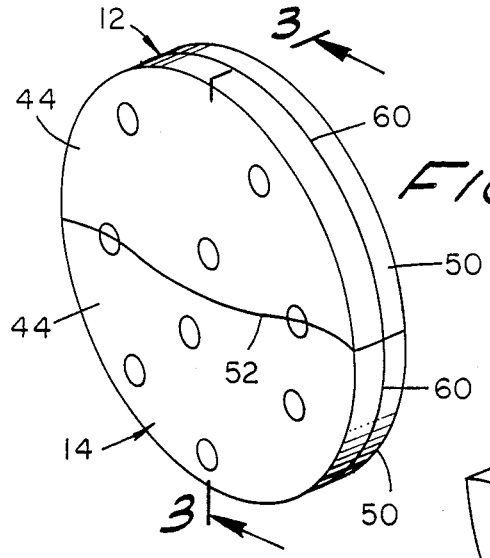
FIG. 1 is a perspective view of the novelty writing instrument of one form of the invention.
Figure 2:
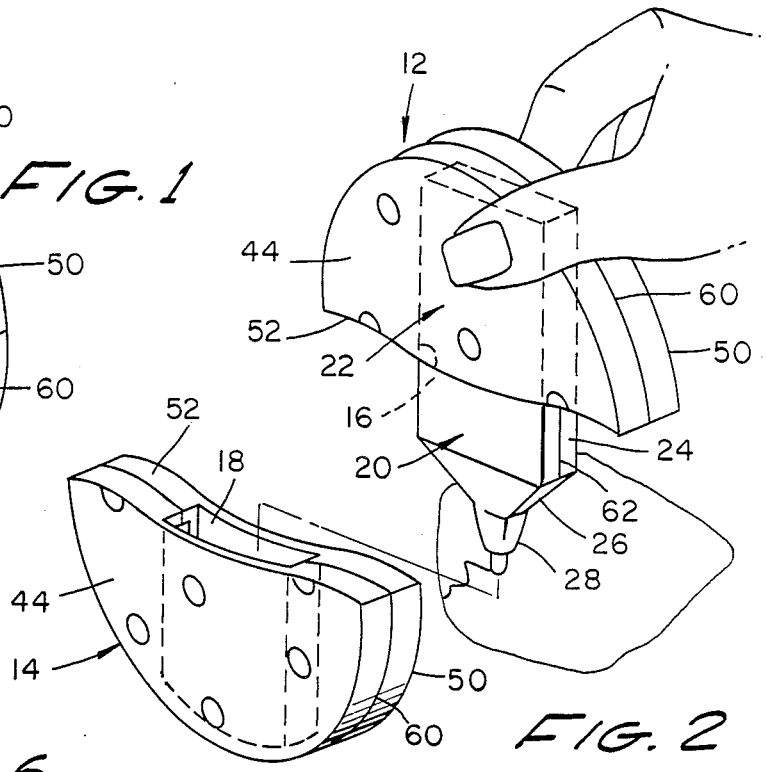
FIG. 2 is an exploded perspective view of the device of the invention shown in a writing configuration.

Referring to the drawings and particularly to FIGS. 1–7, one form of the novelty writing instrument of the present invention is there illustrated. In this form of the invention, the writing instrument is generally circular shaped and includes exterior surfaces designed to simulate the appearance of a cookie. More particularly, the instrument comprises first and second generally semicircular shaped housing portions 12 and 14. Housing portion 12 includes a radially extending cavity 16 formed therein. Similarly, semicircular portion 14 is provided with a radially extending cavity 18. As indicated in FIG. 2, first and second cavities 16 and 18 are aligned when the first and second housing portions 14 and 16 are mateably interconnected in the manner shown in FIG. 1. As best seen in FIGS. 1 and 2, the mating surfaces of the first and second housing portions are curved and generally bisect the circular housing.

Figure 3:
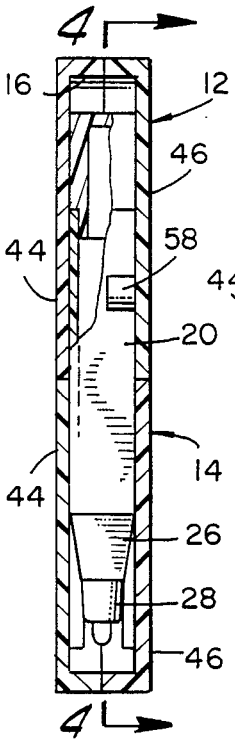
FIG. 3 is a view taken along lines 3—3 of FIG. 1.
Figure 4:
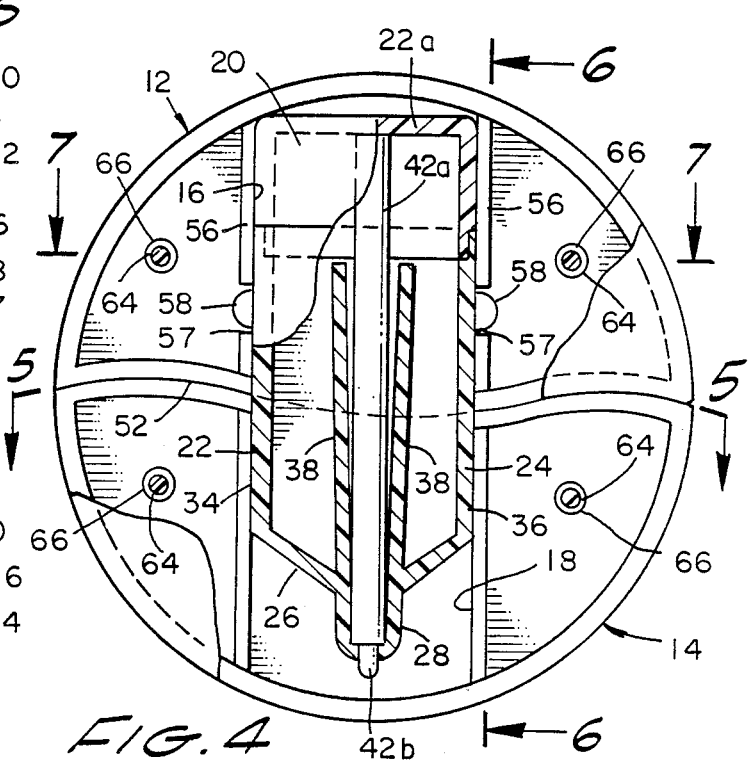
FIG. 4 is a cross-sectional view taken along lines 4—4 of FIG. 3.

Writing means, generally designated by the numeral 20, is mounted within first and second housing portions 14 and 16 for writing on a writing surface when the device is in the writing configuration illustrated in FIG. 2. In the embodiment of the invention shown in FIGS. 1–7, the writing means comprises a first portion 22 having the shape of a polyhedron which is fixedly mounted within cavity 16 of housing portion 12 and a second, or lower, portion 24 which extends outwardly from housing portion 12. As indicated in FIGS. 3 and 4, second portion 14 of the writing means is slidably received within cavity 18 formed in housing portion 14. In the storage and transport configuration of the device of the invention shown in FIG. 1, the writing means is completely encapsulated within the circular shaped housing of the device.

Referring particularly to FIGS. 2 and 4, first portion 22 of the writing means 20 is fixedly mounted within cavity 16 in a manner presently to be described. Second, portion 24, which includes an inwardly tapering lower portion 26 and a generally cylindrically shaped portion 28 which extends downwardly from portion 26.

Figure 5:
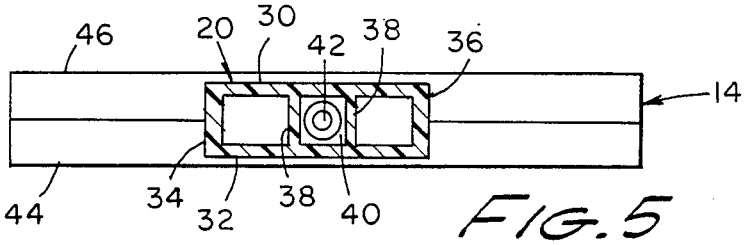
FIG. 5 is a cross-sectional view taken along lines 5—5 of FIG. 4.

Turning to FIG. 5 the writing means 20 can be seen to also comprise spaced apart faces 30 and 32 which are interconnected with spaced apart side walls 34 and 36. A pair of intermediate walls 38 extend between and are interconnected with faces 30 and 32. Walls 38 are spaced apart to define a central passageway 40 within which is mounted a writing element 42. Writing element 42 has an elongated shank portion 42*a* and a writing tip portion 42*b* which protrudes outwardly from the previously identified, cylindrical shaped portion 28 of the writing means (FIG. 2 and FIG. 4). First portion 22 is preferably constructed with a removable cap 22*a* to permit insertion of writing element 42.

Figure 6:
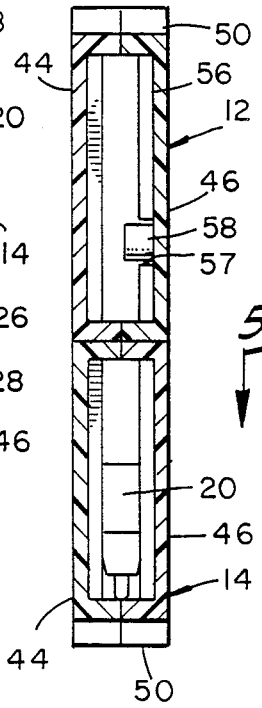
FIG. 6 is a cross-sectional view taken along lines 6—6 of FIG. 4.

Turning now to FIG. 6, each of the housing portions 12 and 14 include a pair of spaced apart, generally planar faces 44 and 46 which are interconnected with circumferentially extending side walls 50. Planar faces 44 and 46 are also interconnected by the previously identified, generally diametrically extending curved mating surfaces or end walls 52 of housing portions 12 and 14 (FIG. 2).

Figure 7:
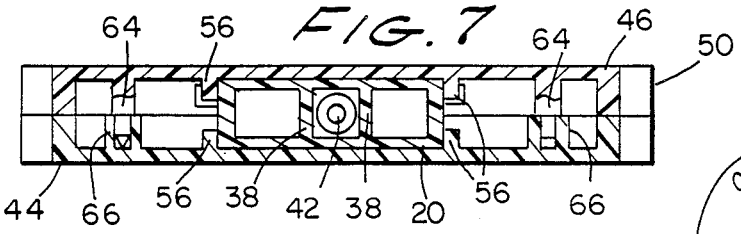
FIG. 7 is a cross-sectional view taken along lines 7—7 of FIG. 4.
Figure 8:
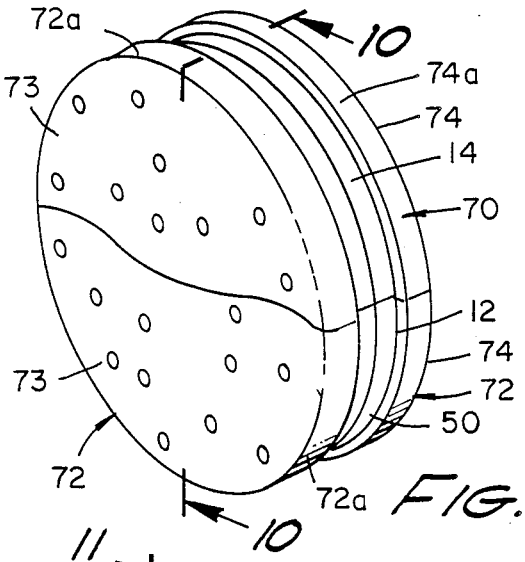
FIG. 8 is a perspective view of an alternate form of writing instrument of the invention having the appearance of a hamburger.
Figure 9:
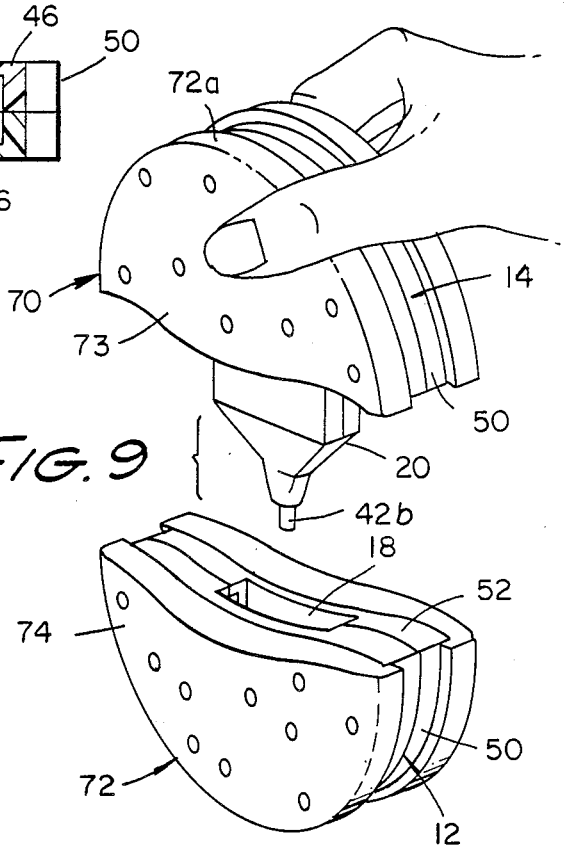
FIG. 9 is an exploded perspective view showing the writing instrument of FIG. 8 in a writing configuration.
Figure 10:
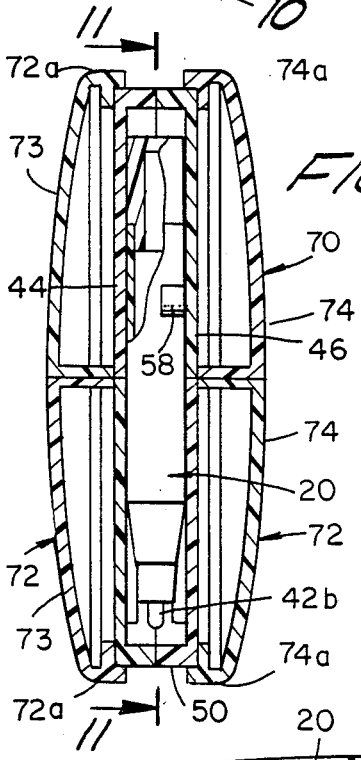
FIG. 10 is a cross-sectional view taken along lines 10—10 of FIG. 8.
Figure 11:
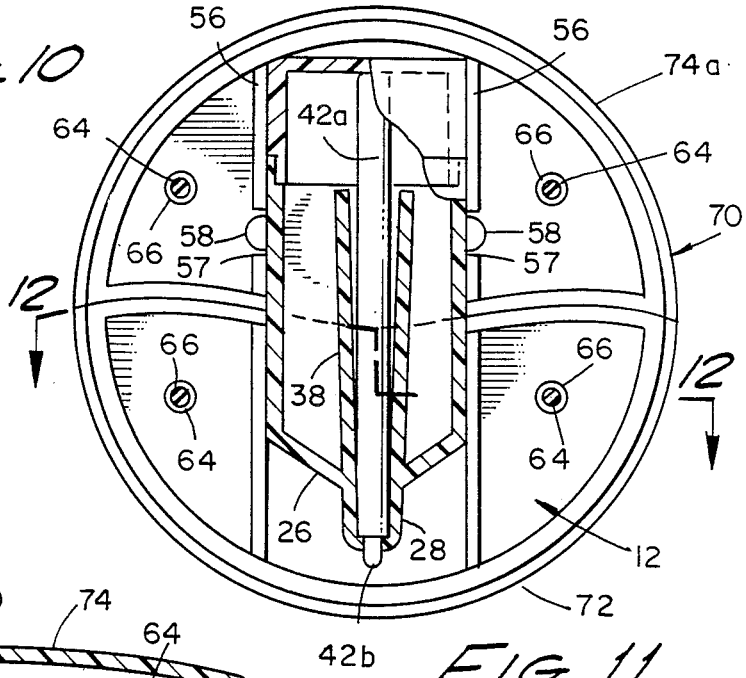
FIG. 11 is a cross-sectional view taken along lines 11—11 of FIG. 10.
Figure 12:
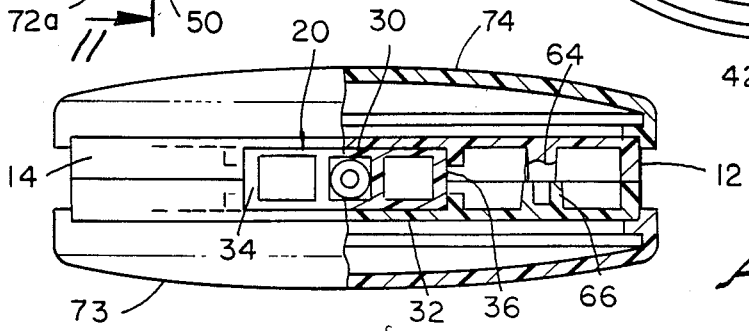
FIG. 12 is a cross-sectional view taken along lines 12—12 of FIG. 11.

As best seen in FIGS. 4 and 7, inwardly protruding transversely spaced walls 56 are provided on planar faces 44 and 46. One pair of walls 56 has a slot 57 which closely receives locking protuberances 58 formed on side walls 34 and 36 of the writing means. This construction functions to fixedly position the writing means within first housing portion 12. Housings 12 and 14 as well as writing means 20, are preferably formed of a moldable plastic material. When so formed, each of the housing portions 12 and 14 is constructed in two halves which are joined at a circumferentially extending junction 60 (FIGS. 1 and 2). Similarly, the writing means is preferably formed in two halves which are joined together at a longitudinally extending junction line 62 (FIG. 2). Each half of the upper and lower housing portions 12 and 14 are interconnected and aligned by means of a pair of spaced apart alignment pins 64 which are interconnected with one face of the housing portions and are closely received within alignment cavities 66 formed on the opposite face 44 of the housing portions. When the upper and lower housing portions are correctly assembled, cavities 16 and 18 are precisely aligned in the manner shown in FIGS. 4 and 6.

Turning to FIGS. 8–12, an alternate form of the writing instrument of the invention is there illustrated. This form of the invention is of similar construction to that previously described and like numerals are used to identify like components. The writing instrument is constructed in two mating halves 70 and 72. The writing means 20 and the housing therefore are contained within halves 70 and 72 and are identical to those previously described.

In this latter embodiment of the invention front and back curved faces 72 and 74 are affixed to the first and second housing portions 12 and 14 by means of circumferentially extending flanges 72*a* and 74*a* (FIGS. 8 and 10), which can be bonded or otherwise affixed to portions 12 and 14. Faces 72 and 74 are provided with design indicia simulating a hamburger bun. Accordingly, when the device is assembled in the manner shown in FIG. 8, it simulates the appearance of a hamburger.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A novelty writing instrument which is generally circular shaped to simulate the appearance of a food product, such as a cookie, or the like, comprising:

(a) a first, generally semicircular shaped housing portion having a radially extending cavity formed therein;

(b) a second, generally semicircular shaped housing portion mateably connected to said first housing portion, said second housing portion having a radially extending cavity formed therein, said cavities of said first and second housing portions being aligned when said first and second housing portions are connected; and (c) writing means mounted within said first and second housing portions for writing on a writing surface, said writing means comprising a first portion fixedly mounted within said cavity of said first housing portion and a second portion slidably receivable within said cavity of said second housing portion.

2. A novelty writing instrument as defined in claim 1 in which each of said first and second housing portions include a circumferentially extending side wall and a curved generally diametrically extending end wall.

3. A novelty writing instrument as defined in claim 2 in which each of said first and second housing portions includes a pair of spaced apart generally planar faces interconnecting said side and end walls thereof.

4. A novelty writing instrument as defined in claim 3 in which each of said faces is provided with indicia simulating the appearance of the surfaces of a cookie.

5. A novelty writing instrument as defined in claim 3 further including front and rear faces connected to said first and second housing portions each of said faces being provided with indicia simulating the appearance of a hamburger bun.

6. A novelty writing instrument as defined in claim 3 in which at least one of said faces of said first housing portion includes at least one inwardly directed locking lug and in which said first portion of said writing means includes a generally planar wall having an aperture adapted to closely receive said locking lug for locking together said writing means and said first housing portion.

7. A writing instrument, comprising:

(a) a generally circular shaped housing including first and second generally semicircular, mateable portions, each said first and second portions comprising a pair of spaced apart, generally planar shaped faces simulating the appearance of the surface of a cookie and each having a cavity formed therein;

(b) writing means carried internally of said housing for writing on a surface, said writing means having a first portion generally rectangular in cross section receivable within the cavity formed in said first portion of said housing and a second portion receivable within said cavity formed in said second portion of said housing, said second portion comprising an inwardly tapering portion and a generally cylindrically shaped portion said writing means including a writing element having a writing point being protruding outwardly therefrom, said writing point being disposed proximate said cylindrically shaped portion of said second portion of said housing.

8. A novelty writing instrument which is generally circular shaped comprising:

(a) a first, generally semicircular shaped housing portion having a radially extending cavity formed therein;

(b) a second, generally semicircular shaped housing portion mateably connected to said first housing portion, said second housing portion having a radially extending cavity formed therein, said cavities of said first and second housing portions being aligned when said first and second housing portions are connected; and (c) writing means mounted within said first and second housing portions for writing on a writing surface, said writing means comprising a first portion mounted within said cavity of said first housing portion and a second portion slidably receivable within said cavity of said second housing portion.

9. A novelty writing instrument as defined in claim 8 in which each of said first and second housing portions include a circumferentially extending side wall, a curved generally diametrically extending end wall and spaced apart generally planar faces.

* * * * *